US006712936B2

(12) United States Patent
Hamad et al.

(10) Patent No.: US 6,712,936 B2
(45) Date of Patent: Mar. 30, 2004

(54) METHOD FOR MANUFACTURING PAPER AND PAPERBOARD USING FRACTURE TOUGHNESS MEASUREMENT

(75) Inventors: Wadood Hamad, Mahwah, NJ (US); Xiang Yu, Paramus, NJ (US); Thomas D. Sandry, Tuxedo, NY (US)

(73) Assignee: International Paper Company, Stamford, CT (US)

( * ) Notice: Subject to any disclaimer, the term of this patent is extended or adjusted under 35 U.S.C. 154(b) by 159 days.

(21) Appl. No.: 09/838,463

(22) Filed: Apr. 19, 2001

(65) Prior Publication Data

US 2003/0041991 A1 Mar. 6, 2003

(51) Int. Cl.[7] ..... D21F 7/06

(52) U.S. Cl. ..... 162/198; 162/49; 162/253; 162/DIG. 6; 162/DIG. 11

(58) Field of Search ..... 162/252, 253, 162/198, 263, DIG. 11, DIG. 6, 49; 73/12, 799; 700/127, 128

(56) References Cited

U.S. PATENT DOCUMENTS 3,490,689 A * 1/1970 Hart et al. ..... 162/DIG. 11
5,013,403 A * 5/1991 Chase ..... 162/49

* cited by examiner

*Primary Examiner*—Steve Alvo
(74) *Attorney, Agent, or Firm*—Ostrager Chong & Flaherty LLP

(57) ABSTRACT

A mathematical model is used to design paper and paperboard having improved runnability. The mathematical model provides an estimate of fracture toughness for an optimized paper product based on specific measurement parameters, e.g., filler percent, softwood content and caliper for optimal fracture toughness. After the optimizing set of measurement parameters has been acquired, these parameters can be used to manufacture grades of paper having improved runnability performance, e.g., in printing presses.

15 Claims, 4 Drawing Sheets

METHOD FOR MANUFACTURING PAPER AND PAPERBOARD USING FRACTURE TOUGHNESS MEASUREMENT

FIELD OF THE INVENTION

This invention generally relates to the manufacture of paper and paperboard products. In particular, the invention relates to engineering and manufacture of grades of paper and paperboard products having improved web runnability.

BACKGROUND OF THE INVENTION

Fracture toughness is an inherent (mechanical) property of every material. In essence, it is the ability of the material to carry loads or deform plastically in the presence of a notch or a defect. In other words, fracture toughness measures the material's ability to resist propagation of a pre-existing crack. In this respect, fracture-toughness testing of paper or paperboard, a complex network of essentially cellulosic fibers, should be constituted within the rubric of established methodologies in fracture mechanics and materials science. More crucially, fracture toughness has been found to be a good predictor of pressroom runnability [Page, D. H., and Seth, R. S., "The problem of pressroom runnability," TAPPI J., 65(8), 92 (1982)], and, in general, end-use performance of paper and paperboard products [Seth, R. S., and Page, D. H., "Fracture resistance: a failure criterion for paper," TAPPI J., 58(9), 112 (1975)].

Crack propagation in cellulosic networks would essentially arise from the development of near- or above-threshold stresses as a result of (external) mechanical, thermal and/or hygroscopic loading, or due to the presence of defects (in whatever form or shape: e.g., defects, shives, irregular web edges, etc.). It should thus become customary within the papermaking industry that fracture toughness be reported alongside elastic moduli and tensile strengths, since it is a fundamental mechanical property that is intrinsically linked to the overall (mechanical) performance of paper or paperboard products. Moreover, fracture toughness can function as an accurate predictor of the performance of paper during manufacturing, printing or converting operations. In all of these operations and most end-use scenarios, external loading is applied in the plane of the paper sheet/web; and if the latter develops high stresses that lead to the propagation of cracks and ultimately failure, that will unequivocally occur in the plane of the paper sheet or web, too. It thus seems sound, particularly from a mechanics-of-materials viewpoint, that assessment of web runnability in presses, converting and end-use performance be principally addressed in terms of the paper fracture toughness. A corollary to the aforesaid would be: engineering better (mechanical) performance during printing and converting, product integrity, reliability and durability for (general) end-use needs to be attempted by primarily, but not exclusively, addressing the material's fracture toughness. In this light, customary industry practice of using out-of-plane tear, via the Elmendorf or Brecht-Imset tests, as a predictor of operational and end-use mechanical performance should be abandoned since it characterizes fracture phenomena occurring in the wrong plane, and thus produces irrelevant results. Moreover, neither the Elmendorf nor the Brecht-Imset tear test characterizes deformation beyond the elastic scope.

Three primary factors control the susceptibility of a material to fracture: fracture toughness, crack size and stress level. These primary factors are in turn influenced by other considerations. In the case of paper, they are influenced by papermaking variables (e.g., % filler, refining consistency, Kraft to groundwood ratio), environment (temperature and moisture), stress concentration (presence and size of defects), residual stresses, etc. Instituting an appropriate test for the material's fracture toughness would be the first step to understanding its resistance to cracking, or lack thereof. An appropriate test would essentially depend on the failure mode and the nature of the fracture region (elastic, elastic-plastic or fully plastic). Two considerations are relevant for paper and paper products' end-use performance: a) All failures in print presses and converting operations occur in the plane of the paper sheet or web; b) Owing to the highly viscoelastic nature of the cellulosic network, the zone ahead of the propagating crack tip is appreciably plastic. Based on these considerations, a test is required whereby a notched specimen is loaded in tension in the plane of the specimen. The rate of applying tensile loading must be such that stable crack propagation is ensured.

Paper is a tough elastic-plastic material with a low yield stress. When strained, paper yields not only at the crack tip where the strains are high, but also the material away from the crack tip can yield (refer to FIG. 1). This, which results because the material resists crack propagation and requires larger strains for the crack to propagate, substantially complicates fracture toughness testing. It is thus indicated that permanent deformation is no longer confined to the fracture process zone (the zone ahead of the crack tip where fiber breakage and bond breakage are concentrated) as it is for an elastic material, but can spread throughout the material. The extent of deformation away from the crack depends on the size of the crack relative to the specimen width and on the toughness of the material. Thus, in addition to work consumed in the fracture process zone (work essential to fracture), work is also consumed in the yielded regions away from the crack tip (work not essential to fracture). The area under the load versus elongation curve (see FIG. 2) of the fractured material represents the total work of fracture, i.e., the combination of contributions to fracture and remote deformation. Separating these two contributions (a non-trivial task) makes possible the estimation of fracture toughness, or the essential work of fracture: work done per unit new crack area [see Cotterell, B., and Reddel, J. K., "The essential work of plane stress ductile fracture," Int. J. Fracture 13(3), 267 (1977)].

Two approaches have mainly been followed for measuring the in-plane fracture toughness of tough ductile paper: the "J-integral" approach and the "essential work of fracture" approach. One important consideration in choosing an approach should be the ability to determine the material property independent of specimen size. (Large changes can occur in the load versus elongation behavior of paper when, for example, refining energies are increased/decreased, and it thus becomes imperative that the instituted test measure the real fracture toughness of the sample and not some artifacts of the test.) Two significant issues are associated with conducting J-integral testing: a) Several research findings published in the open literature indicate that fracture toughness results independent of specimen size and crack geometry were not obtained; b) A crucial consideration in the J-integral calculations would be to precisely identify the onset of crack initiation in a specimen. This is an extremely complex point and may only precisely be addressed by utilizing what is referred to as the direct-current potential difference method, which has successfully been used, for instance, for J-integral determination of fracture toughness for steel. This approach, which basically correlates crack propagation with the electrical potential difference and hence identifies very precisely the onset of crack initiation, is excruciatingly laborious to execute. It has, perhaps, therefore not been adopted for paper testing in any research laboratory within industrial or academic centers. On the other hand, the essential work of fracture (e.w.f.) method was shown to give results independent of specimen size [see Seth, R. S., Robertson, A. G., Mai, Y-W. and Hoffmann, J. D., "Plane stress fracture toughness of paper," TAPPI J. 76(2), 109 (1993) and Seth, R. S., "Plane stress fracture toughness and its measurement for paper," in: Products of Papermaking, Trans. of Tenth Fund. Res. Symp., Oxford, C. F. Baker (ed.), PIRA International, Leatherhead, Surrey, U. K., p. 1529 (1993)] and, more critically, because of the set-up involved, no onset of crack initiation is required for determining the final calculations. Within the constraints of available tools in fracture mechanics, the e.w.f. method is the easiest and best assessor of fracture toughness of paper and paperboard.

There is a need to develop a fundamental understanding of what and how papermaking variables affect the fracture toughness of paper and paperboard. Such an understanding would enable the better design of products, such as lightweight coated grades of paper, for optimal runnability.

SUMMARY OF THE INVENTION

The present invention is a method of manufacturing paper or paperboard using a design approach based on fracture toughness for achieving improved runnability, e.g., minimal web breaks in presses. The fracture toughness-based approach disclosed herein can be utilized to cost-effectively design grades of paper, e.g., through minimizing raw material intake. Although the examples disclosed below pertain to lightweight coated grades of paper, the fracture toughness-based approach of the present invention is more encompassing and can be applied to the design of all paper and paperboard grades. The fracture toughness-based approach also makes possible the optimization of pulping and papermaking variables, such as fiber length, viscosity, etc.

In accordance with the preferred embodiment of the invention, a mathematical model is used to design paper and paperboard having improved runnability. The mathematical model provides an estimate of fracture toughness for an optimized paper product based on specific measurement parameters, e.g., filler percent, softwood content and caliper for optimal fracture toughness. After the optimizing set of measurement parameters has been acquired, these parameters can be used to manufacture grades of paper having improved runnability performance, e.g., in printing presses.

To arrive at a mathematical model, a factorial experiment was carried out to investigate the effects of papermaking variables on the in-plane fracture toughness, an inherent mechanical property of paper. A statistically significant model for fracture toughness as a function of filler percent, softwood content and caliper resulted from the rigorous experimental testing and analysis. The experimental results showed that fracture toughness decreases with increasing filler content; and, for a specific filler content, fracture toughness increases by about 10% when the softwood content is increased by around 4%. If the caliper is doubled, keeping the softwood and filler contents the same, fracture toughness increases by about 50%. Modeling of fracture toughness holds meaningful results for the machine direction (MD) only. Concomitantly, stiffness was found to be proportional to basis weight and caliper and inversely proportional to filler content.

Furthermore, it was found that fracture toughness does not correlate, in either the cross direction (CD) or the machine direction, with the elasticity modulus, tensile strength, stiffness, tear or formation index, when considered for a specific caliper range. The experimental findings revealed the important role fracture toughness plays in affecting a sheet's performance. Fracture toughness is an important design consideration for optimal web runnability and general end use performance of, for example, lightweight coated (LWC) grades. In accordance with the preferred embodiment of the invention, the mathematical model provides a basis for outlining critical operating parameters for optimal fracture toughness performance within a papermaking mill.

DETAILED DESCRIPTION OF THE PREFERRED EMBODIMENTS

Figure 1:
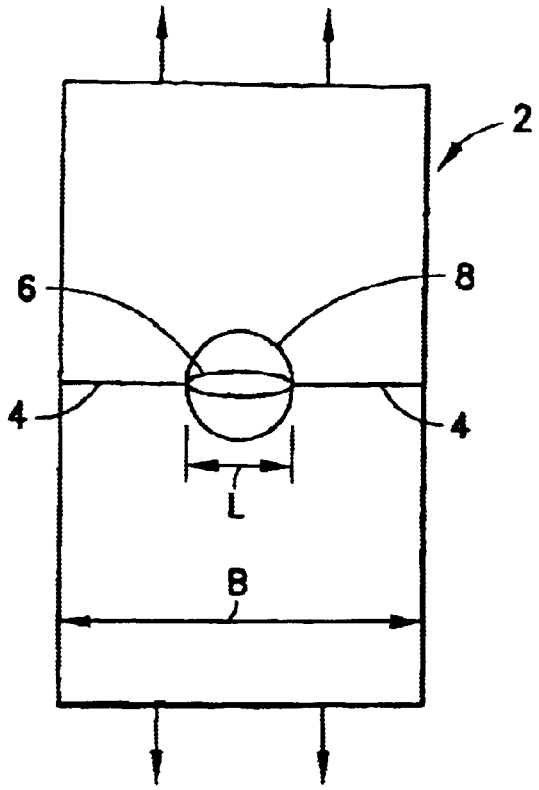
FIG. 1 is a schematic showing a deep double-edge notched tension (DENT) specimen showing the fracture process zone and the outer plastic region.
Figure 2:
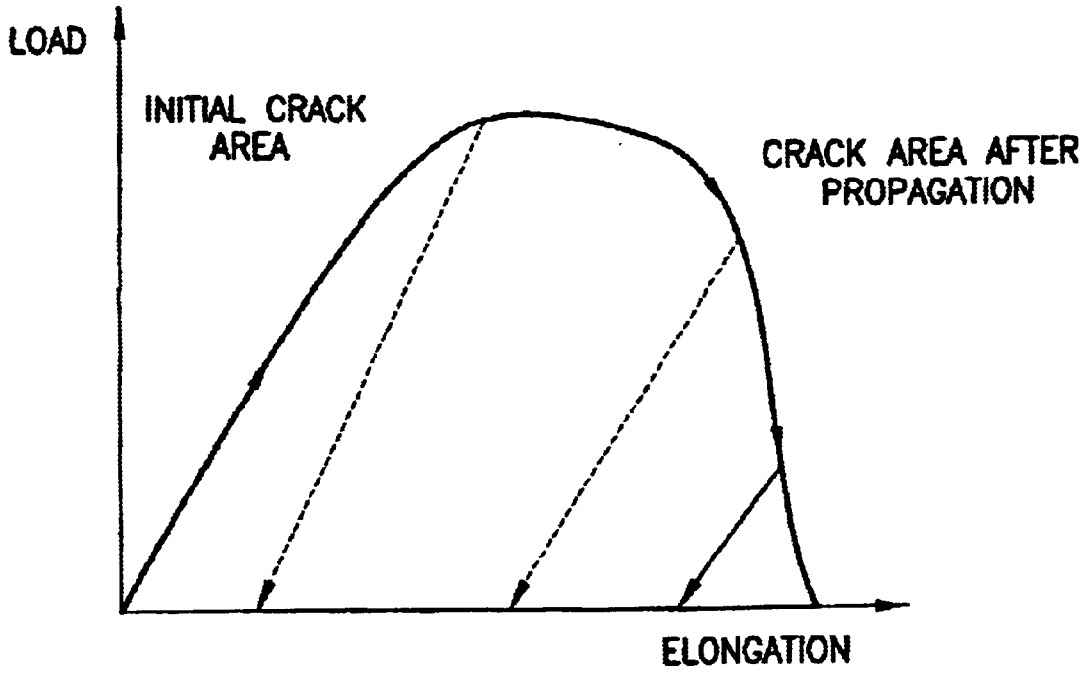
FIG. 2 is a graph showing a load-elongation curve for crack propagation in an elastic-plastic material under in-plane tension. The elongation is not zero when the specimen is unloaded, indicating energy consumption due to irrecoverable deformation away from the crack.

In accordance with the preferred embodiment of the present invention, a factorial experiment was carried out to investigate the effects of papermaking variables on the in-plane fracture toughness of the resulting paper product. The experimental work focused on developing a fundamental understanding of what and how papermaking variables affect the fracture toughness of paper, thus ultimately enabling paper manufacturers to better design paper products, e.g., LWC grades, for optimal runnability. The principal premise was that the energy consumed in fracturing a material (the essential work of fracture or fracture toughness) is an independent material property whose value, in the case of paper, may primarily be influenced by process- and material-related variables. Following the experiment, the inventors sought to ascertain physical models for fracture toughness, thereby offering guidelines for (re)defining the key operational parameters required for LWC paper production having optimal press runnability. However, the factorial experiment and mathematical model could be respectively conducted and derived for any paper or paperboard grade, not just LWC grades.

Paper properties result from the complex interaction of the chemical and physical interactions between its constituents, the physical/chemical/micro-mechanical properties of the individual constituents, and processing and environmental variables. In the pursuit to study how fracture toughness impacts runnability, it is necessary to identify variables (process- and material-related) that are quantifiable, relatively easily measurable and have a measured influence on the desired responses. Therefore factors such as viscosity, that may not practically be controllably measured, should be excluded. The preferred variables are accurately quantifiable and intrinsically related to the sheet's performance.

A factorial experimental design was pursued whereby three quantitative independent variables (or factors), viz., percent filler (by weight), refining consistency and softwood/groundwood ratio, and one qualitative factor, nip load, were considered. The softwood/groundwood ratio is the ratio of chemically processed wood pulp (e.g., obtained by the kraft, i.e., sulfate, process) to mechanically treated wood pulp (e.g., obtained by grinding wood chips). The covariates were caliper, basis weight, relative humidity, temperature and density. [Fracture toughness testing was performed in a room where controlled conditions of 50±5% (relative humidity) and 23±2° C. (temperature) were presumed. However, there were not insignificant fluctuations in relative humidity, due to inadequate control, over a two-month period of testing during the summer where outside humidity was relatively high. A record was kept of all temperature and humidity readings and the fluctuations in the latter were incorporated when analyzing the data and constructing the models.] Viscosity was not varied. The measured responses included: fracture toughness, internal bond, tear, stiffness (Gurley), z-directional tensile, zero-span tensile and formation index.

Ten conditions were studied with the first and last runs being controls at levels as indicated in Appendix I. (The case identification is given in Table I.1.) Oriented handsheets were made on the Formatte Dynamique Auto Dynamic Sheet Former (DSF), which was set to collect the white water and then used to dilute the succeeding batch and additives. Enough amounts of pulp were added to the DSF to make 5 sheets per batch. The DSF required a minimum of 4 or 5 liters of the diluted pulp to circulate through the system in addition to the amount used to make the sheets. As a result, each batch of pulp charged to the machine could only make three sheets.

Two pulps, groundwood and bleached softwood, were used in the handsheet study. The groundwood pulp was at about 4.5% solids and 35 CSF; it was used as is. The softwood was shipped in dry form at 73% solids unrefined. It was refined in a valley beater. Five hundred grams (dry) of softwood diluted to 2% was refined as follows:

| Time (minutes) | 0 | 24 | 27 | 38 |
|---|---|---|---|---|
| CSF | 754 | 632 | 600 | 557 |

[CSF (Canadian standard freeness) is a measure of refining energy. For standard levels of input energy, CSF is a measure of how much of refined fibers will pass through a tube of specified diameter.] The filler which was added to the fiber slurry was calcium carbonate. The procedure for each condition was to first make three sheets, collect the white water and dispose of the sheets. This white water was used to dilute the next batch of pulp. This was repeated thrice and a total of nine sheets per condition were made. The white water was disposed of after making the last sheet for each condition. The same was repeated for all other conditions. The DSF was set to the following: Flow=2.0, wire speed=1350 rpm, dewatering time=30 sec, white water collect=yes, white water scope setting=2, compacting: speed=1800 rpm, time=60 sec. Pressing was performed at a pressure of 1 bar and 1 pass, drying at 120° C. for 5–8 minutes.

Fracture toughness measurements were performed on deeply double-edge notched tension (DENT) specimens (see FIG. 1) having various ligament lengths, L. The measurement of the in-plane fracture toughness of paper simply involved measuring the total work of fracture $W_f$ for a range of ligament lengths L, and determining the essential work of fracture $w_e$ from the intercept of the $w_f$ versus L linear relationship, where $w_f=W_f/(L\times B.W.)$ and B.W. is the basis weight. Appendix II (Tables II.1 and II.2) contains the raw fracture toughness data for the eleven sets of conditions. As a confirmation of the reliability of the experimental results, the measured fracture toughness results compared well with theoretical estimates. A description of the physical properties for the eleven handsheet sets is given in Table III.1 (see Appendix III. Tables III.2 and III.3 contain the fracture toughness and relevant stiffness results for all samples. For Table III.3, the internal bond was measured using the test designated TAPPI T833 PM-94; the Gurley stiffness was measured using the test designated TAPPI T543 OM-94. The accuracy of the fracture toughness measurements are attested to by the good R-squared values (with the exception of Case 11MD, but the latter's fracture toughness value is still within the expected range of values). The last column of Table III.2, $\beta w_p$, the product of the fracture-process-zone shape factor $\beta$ and the non-essential work of fracture $w_p$, or the slope of the $w_f$ versus L graphs (refer to Appendix II), relates, strictly speaking, to the relative resistance of the sheet to crack growth (for the specific specimen geometry), and to the sheet's ductility. The quantity $\beta w_p$ was used as an approximation of the sheet's ductility, i.e., $\beta w_p$ increases with ductility of the sheet and vanishes for brittleness. Furthermore, when examining Tables 1 and 2, it is interesting to note that the sheets with the higher slopes tend to be more extensible.

The mechanical properties of Table III.3 when plotted versus fracture toughness, for MD and CD, indicate no correlation of any practical importance. That is to say, for a specific caliper range, fracture toughness is an independent parameter that may not be inferred from other fundamental properties, e.g. tensile strength or elasticity modulus. Along the same lines, fracture toughness does not correlate with stiffness, tear, zero-span or formation index either. These findings clearly validate the argument that fracture toughness needs to be considered as an independent variable, for which paper must be designed.

Fracture toughness is important as an independent variable for design. A factorial experiment was designed to study what variables affect fracture toughness performance and how these effects are achieved.

The experimental factors centered around the control (refer to Appendix I for definition of control, etc.) were:

$x_1$=filler−8

$x_2$=softwood−58.6153846

$x_3$=CSF−593.8461538

The covariates (centered) are:

$z_1$=basis weight−42.0384615

$z_2$=caliper−0.1036923

$z_3$=relative humidity−54.8461538

$z_4$=temperature−21.5096154

$z_5$=density−0.4077778

The measured responses were:

$Y_1$=fracture toughness, *FT*

$Y_2$=internal bond, *IB*

$Y_3$=tear strength $Y_4$=Gurley stiffness, *GS*

$Y_5$=*z*−directional tensile strength $Y_6$=zero-span tensile strength $Y_7$=formation index The complete data set, nine uncalendered and two calendered cases (see Appendix I), was evaluated for predictions. Detailed discussion of the fracture toughness model will be given, with relevant remarks in relation to the other responses.

Fracture toughness was found to fit the following model:

$$FT=\beta_0-\beta_1x_1+\beta_2x_2+\beta_3z_2$$

where the variables are as defined above. The parameters $\beta_0$–$\beta_3$ are dependent on the particular grade of paper or paperboard being manufactured. For the factorial experiment, the target grade was Hudson Web Gloss and the parameter estimates were as follows: $\beta_0$=22.3978, $\beta_1$=0.55214, $\beta_2$=0.46064, and $\beta_3$=180.8194. The model's relevant statistics were $R^2$=0.86 and F=29, where F represents the statistical F-test value.

Figure 3:
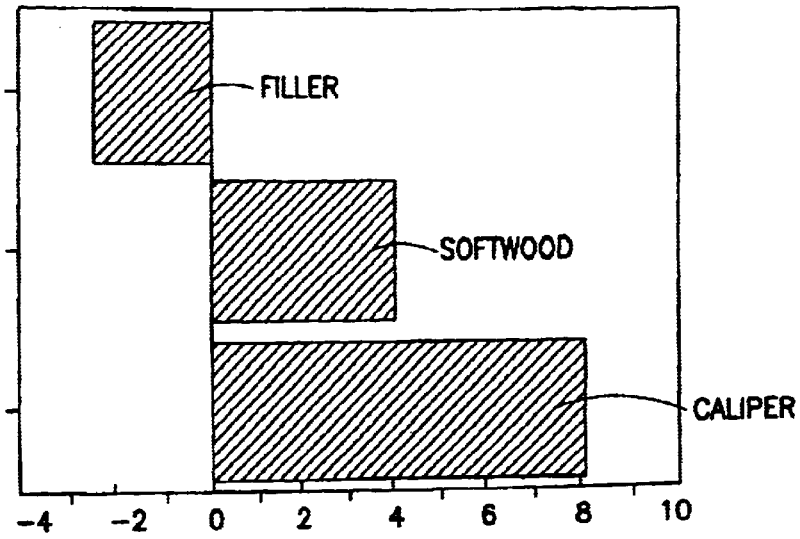
FIG. 3 is a bar chart showing T-statistics results indicating the levels of variance for the factors associated with the fracture toughness model. The cut-off level, i.e., the level relative to which a factor's importance may be discerned, is ±2.201.
Figure 4:
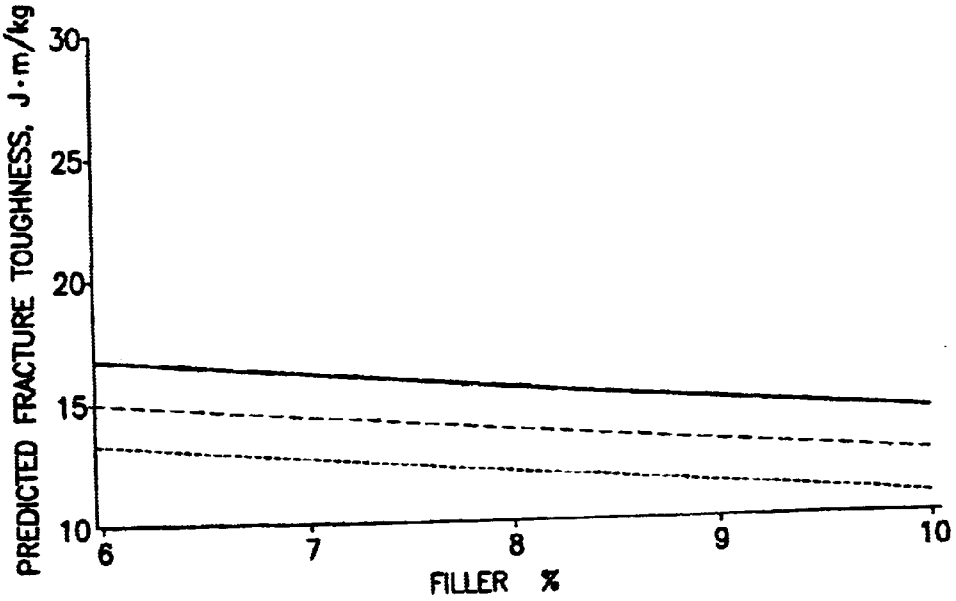
FIG. 4 is a graph showing predictions in fracture toughness based on filler percent and softwood contents for a specified caliper.
Figure 5:
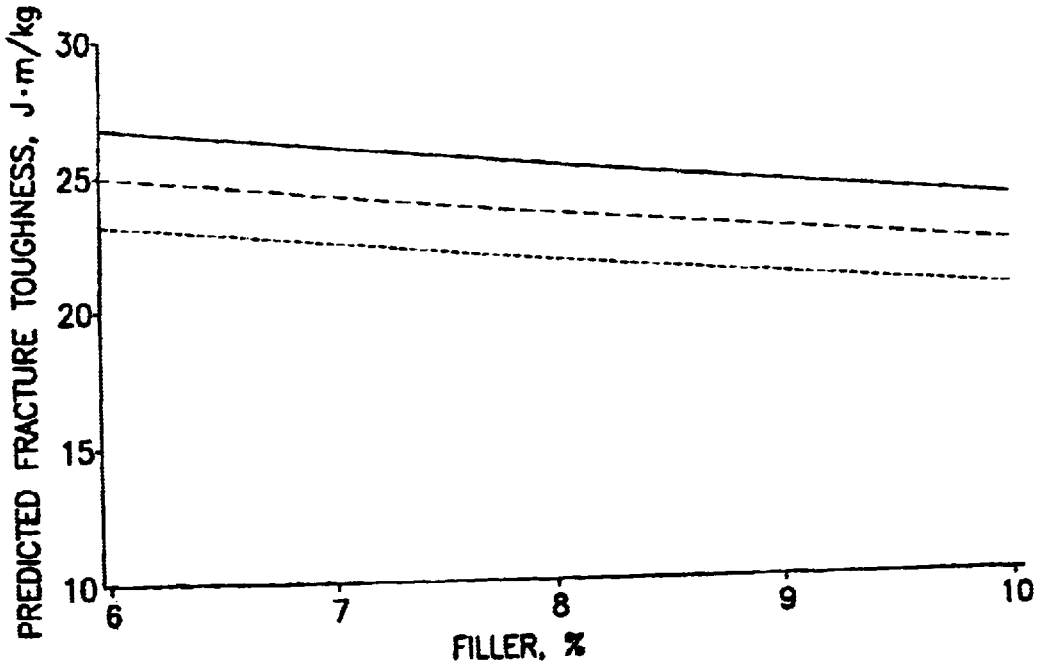
FIG. 5 is a graph showing predictions in fracture toughness, when the caliper is doubled, based on filler percent and softwood contents.

The proposed fracture toughness model, with good statistical fit, predicts an increase in fracture toughness with increasing caliper and softwood content and decreasing levels of filler. FIG. 3 diagrammatically depicts the T-statistics results for fracture toughness resulting from the above model with 11 degrees of freedom and all terms being significant at the 0.05 level. It is important to note that the bars in FIG. 3 represent the magnitude of the variation level associated with each factor; the sign represents the direction of variation. The upper/lower level of the Student's T-distribution, or the level relative to which a factor's importance may be discerned, i.e., the cut-off level, is ±2.201. It may therefore be deduced that caliper has the most significant effect, with the softwood and filler contents being successively lesser in significance. For example, at a specific caliper level, fracture toughness increases by over 10% when the softwood contents increase by only 4% for a specified filler content. When the caliper is doubled the corresponding fracture toughness levels are increased by over 50% (at a specified filler content); the magnitude of increase in fracture toughness with increasing softwood contents remains similar. As evinced in FIGS. 4 and 5, the predicted fracture toughness steadily decreases with increasing filler contents. It is important to note that the fracture toughness model applies for the MD case, and no meaningful relationships may be discerned for the CD direction.

The strong fracture toughness model was supported by equally strong models for internal bond and Gurley stiffness. Internal bond was found to be proportional to basis weight and inversely proportional to relative humidity and filler content. As for stiffness, it is proportional to basis weight and caliper and inversely proportional to filler content. The respective mathematical formulae are:

$$IB=\beta_0-\beta_1x_1+\beta_2z_1-\beta_3z_3$$

where $\beta_0$=116.3, $\beta_1$=5.7718, $\beta_2$=5.5578, $\beta_3$=1.0137, $R^2$=0.87, F=23; and $$GS=\beta_0-\beta_1x_1+\beta_2z_1+\beta_3z_2$$

where $\beta_0$=48.2085, $\beta_1$=1.1130, $\beta_2$=2.2471, $\beta_3$=566.8, $R^2$=0.98, F=163.

Figure 6:
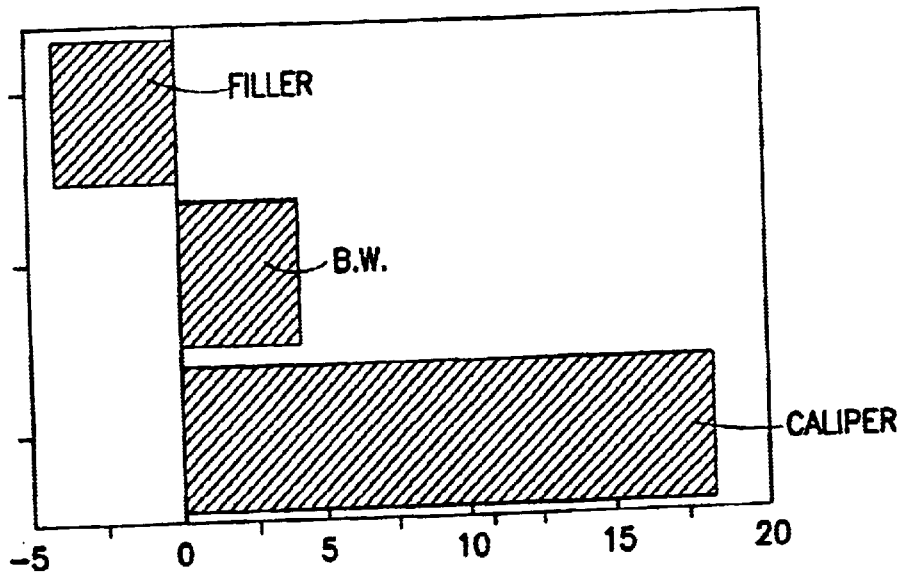
FIG. 6 is a bar chart showing T-statistics results indicating the levels of variance for the factors associated with the (Gurley) stiffness model. The cut-off level is ±2.365. (B.W.= basis weight).
Figure 7:
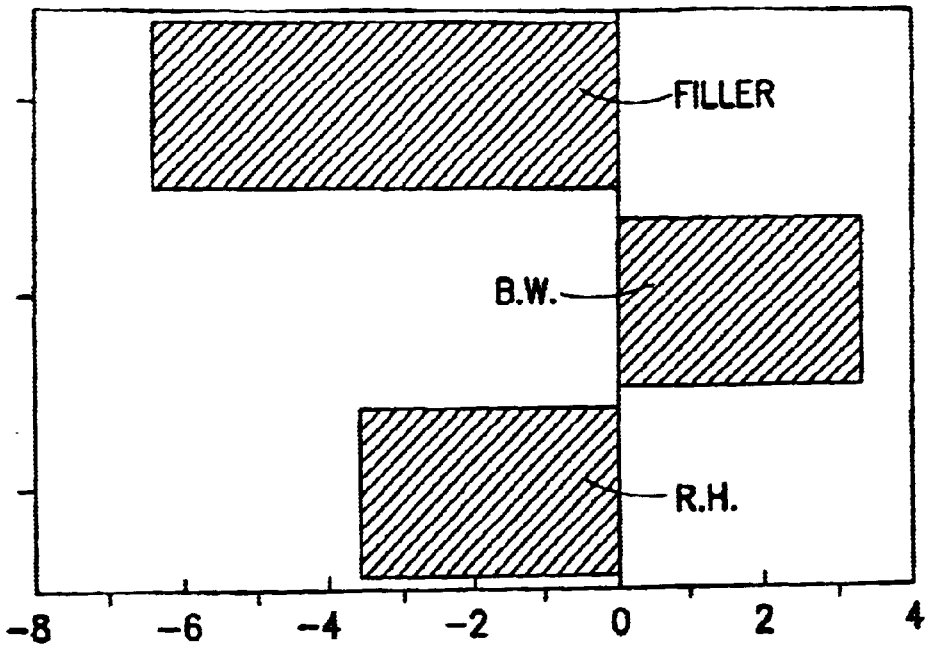
FIG. 7 is a bar chart showing T-statistics results indicating the levels of variance for the factors associated with the internal bond model. The cut-off level is ±2.447. (B.W.= basis weight, R.H.=relative humidity).

The T-statistics results indicating the levels of variance for the factors associated with the Gurley stiffness and internal bond models are graphically illustrated in FIGS. 6 and 7 respectively. It should be noted that all terms in the above three models are significant when assessing the statistical reliability of the terms making up any one model).

Tear strength predicts fracture phenomena in the out-of-plane mode, that is to say, at 90 degrees to the plane at which actual fracture phenomena may occur during, for instance, running a web in a press (e.g. web breaks), or in most converting and end-use cases. The experimental results clearly indicated, as expected, a lack of correlation between in-plane fracture toughness and out-of-plane tear. It need be further emphasized that in-plane fracture toughness, rather than out-of-plane tear, is the only accurate means for evaluating web runnability through the examination of what and how papermaking variables affect its performance. Below we will offer further indication into the appropriate use of fracture toughness predictions for runnability.

Figure 8:
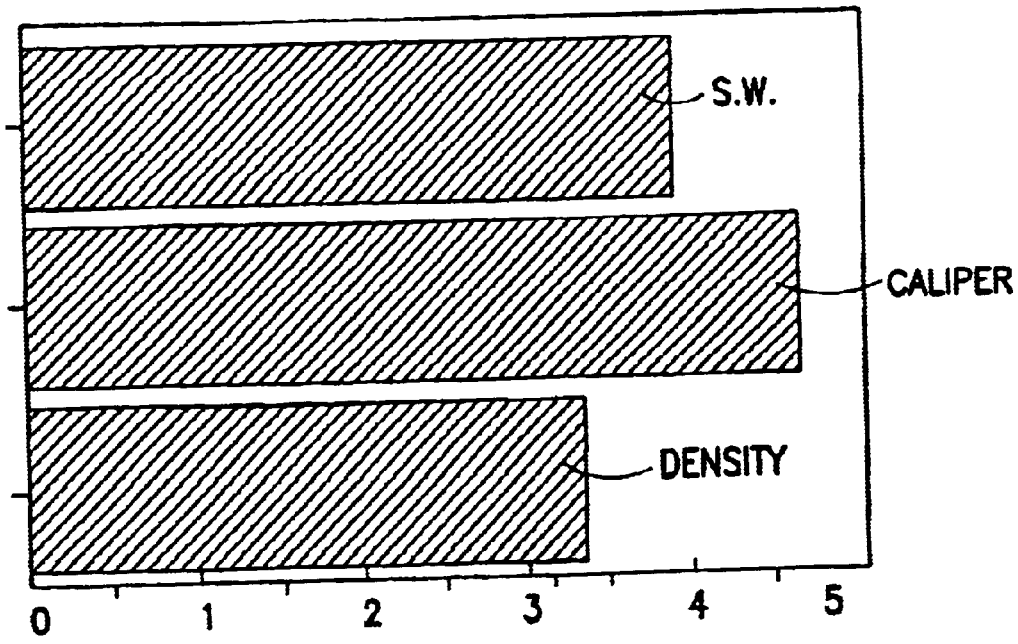
FIG. 8 is a bar chart showing T-statistics results indicating the levels of variance for the factors associated with the tear strength model. The cut-off level is ±2.365. (S.W.=softwood content).

A model predicting tear in the MD direction as a function of experimental factors and covariates was engendered ($R^2$=0.94, F=53) and was found to be proportional to softwood content, caliper and density. The T-statistics analysis of variance reveals that the three terms affect tear strength at almost equivalent levels (see FIG. 8). Low levels of variation in softwood content, caliper and density would provide a very small window to effect any change, if at all, in tear performance, thus further limiting the usefulness of tear strength as a predictor to change paper performance. On statistical grounds, the latter stands in stark contrast to what the fracture toughness model is capable of predicting, as previously described.

In conclusion, plane-stress fracture toughness is an important sheet property, and must be considered for optimal paper performance, e.g., runnability of LWC grades in print presses. The essential work of fracture concept is a simple and practical way for evaluating the fracture toughness of paper and paperboard.

A statistically significant model for fracture toughness indicates the latter as a function of decreasing filler percent, increasing softwood content and increasing caliper. Caliper level variations have the most effect on increasing fracture toughness: doubling the caliper would increase fracture toughness by over 50%, for the same levels of softwood and filler contents; at the same filler level, increasing the softwood contents by 4% would increase the fracture toughness by around 10%. Fracture toughness may be optimized for a decreasing trend in filler percent. Internal bond and stiffness follow similar trends as previously explained.

Optimal performance is associated with maximizing the ability of a sheet to resist cracking, or retard crack propagation once a crack is initiated, i.e., the sheet's in-plane fracture toughness, thereby prolonging the sheet's integrity to withstand printing and other converting operations. The optimal range of fracture toughness for acceptable press runnability performance of a particular grade of paper or paperboard is preferably determined by a print-press field study.

The present invention is further directed to a method of operating a papermaking mill. In accordance with that method of operation, fracture toughness is instituted as a standard test. Also the fracture toughness model described herein can be used as the basis for outlining critical operating parameters for optimal fracture toughness performance.

The present invention is further directed to a method of designing a grade of paper or paperboard based on fracture toughness. More specifically, paper or paperboard can be designed using a mathematical model of fracture toughness as a function of a plurality of variables respectively representing filler level, softwood pulp content and caliper. First, a desired fracture toughness is determined. Then respective values for each variable are inserted in the mathematical model, the values being determined so that the mathematical model produces a fracture toughness value approximately equal to the desired fracture toughness value. A production line is then set up for manufacturing a paper or paperboard product having respective material properties corresponding to the determined respective values. Early in the production run, the process is halted, test samples are taken from the manufactured product and the fracture toughness of the test samples is measured using the essential work of fracture approach. To the extent that there is a discrepancy between the desired fracture toughness and the measured fracture toughness, one or more of the variables included in the mathematical model can be adjusted. For example, to increase fracture toughness, any one of the following steps can be taken: decrease the filler level; increase the softwood pulp content; or increase the caliper of the product. Then production is resumed. The filler level, softwood pulp content and caliper can be adjusted until a product is manufactured in which the discrepancy between the measured and desired fracture toughness is within acceptable tolerances.

Over time, material property data for various manufactured grades of paper and paperboard can be accumulated in a databank. The material property data in the databank would comprise fracture toughness measurements, caliper, softwood pulp contents and filler levels for by mill or grade. Optionally, critical operating parameters associated with a particular grade can also be stored in the databank.

While the invention has been described with reference to preferred embodiments, it will be understood by those skilled in the art that various changes may be made and equivalents may be substituted for elements thereof without departing from the scope of the invention. In addition, many modifications may be made to adapt a particular situation to the teachings of the invention without departing from the essential scope thereof. Therefore it is intended that the invention not be limited to the particular embodiment disclosed as the best mode contemplated for carrying out this invention, but that the invention will include all embodiments falling within the scope of the appended claims.

Appendix I: Details of Handsheet Study for Hudson Web Gloss

TABLE I.1

| Case | Filler % | Kraft % | Groundwood % | Refining (CSF) |
|---|---|---|---|---|
| 1 (control) | 8 | 58 | 42 | 600 |
| 2 | 6 | 55 | 45 | 550 |
| 3 | 10 | 55 | 45 | 550 |
| 4 | 6 | 63 | 37 | 550 |
| 5 | 10 | 63 | 37 | 550 |
| 6 | 6 | 55 | 45 | 630 |
| 7 | 10 | 55 | 45 | 630 |
| 8 | 6 | 63 | 37 | 630 |
| 9 | 10 | 63 | 37 | 630 |

Case 10: Same as control, case 1, but cold calendered (steel-to-steel) to 556 pli
Case 11: Same as control, case 1, but cold calendered (steel-to-steel) to 1111 pli Appendix II: Data for Determining Fracture Toughness Based on the E. W. F. Approach We present here the data for fracture energies for the tested samples, along with standard deviations and normalized fracture energies.

TABLE II.1

Fracture energy and related data for tested handsheets

| Sample label | Sample Sub-label | Comments | Number of samples | L (mm) | t (mm) | B.W. (gsm) | Wf (J) | Wf - S.D. (J) | Wf/(Lt) (J/mm2) |
|---|---|---|---|---|---|---|---|---|---|
| Case | MD10 | Control | 10 | 10 | 0.105 | 41.4 | 0.011 | 0.001 | 0.0104861 |
| 1A | MD15 | | 6 | 15 | 0.102 | 41.4 | 0.018 | 0.001 | 0.0117119 |
| | MD20 | | 6 | 20 | 0.105 | 41.8 | 0.026 | 0.001 | 0.0123576 |
| | MD25 | | 6 | 25 | 0.106 | 42.7 | 0.037 | 0.003 | 0.013936 |
| | CD10 | | 10 | 10 | 0.103 | 42.1 | 0.004 | 0 | 0.0038747 |
| | CD15 | | 6 | 15 | 0.109 | 43.7 | 0.008 | 0.001 | 0.004902 |
| | CD20 | | 6 | 20 | 0.103 | 41.6 | 0.011 | 0.001 | 0.0053218 |
| | CD25 | | 6 | 25 | 0.105 | 43.1 | 0.019 | 0.002 | 0.0072206 |
| 1B | MD10 | Repeat | 10 | 10 | 0.100 | 39.4 | 0.01 | 0.001 | 0.0099966 |
| | MD15 | | 6 | 15 | 0.100 | 39.9 | 0.02 | 0.003 | 0.0133118 |
| | MD20 | | 6 | 20 | 0.109 | 45.3 | 0.028 | 0.002 | 0.0128832 |
| | MD25 | | 6 | 25 | 0.099 | 40.8 | 0.038 | 0.004 | 0.0153244 |
| | CD10 | | 10 | 10 | 0.103 | 41.2 | 0.005 | 0.001 | 0.0048767 |
| | CD15 | | 6 | 15 | 0.101 | 39.7 | 0.009 | 0.001 | 0.0059493 |

TABLE II.1-continued

Fracture energy and related data for tested handsheets

| Sample label | Sample Sub-label | Comments | Number of samples | L (mm) | t (mm) | B.W. (gsm) | Wf (J) | Wf - S.D. (J) | Wf/(Lt) (J/mm2) |
|---|---|---|---|---|---|---|---|---|---|
| | CD20 | | 6 | 20 | 0.108 | 45.4 | 0.014 | 0.002 | 0.006476 |
| | CD25 | | 6 | 25 | 0.107 | 43.4 | 0.018 | 0.001 | 0.0067297 |
| 1C | MD10 | Repeat | 10 | 10 | 0.104 | 42.6 | 0.012 | 0.001 | 0.0115332 |
| | MD15 | | 6 | 15 | 0.102 | 41.6 | 0.019 | 0.002 | 0.0123793 |
| | MD20 | | 6 | 20 | 0.102 | 42.3 | 0.027 | 0.002 | 0.0131922 |
| | MD25 | | 6 | 25 | 0.097 | 39.2 | 0.034 | 0.003 | 0.0140595 |
| | CD10 | | 10 | 10 | 0.103 | 43.5 | 0.006 | 0.001 | 0.0058297 |
| | CD15 | | 6 | 15 | 0.103 | 42.5 | 0.008 | 0.001 | 0.0051817 |
| | CD20 | | 6 | 20 | 0.101 | 41.9 | 0.012 | 0 | 0.0059352 |
| | CD25 | | 6 | 25 | 0.100 | 41.2 | 0.016 | 0.002 | 0.0063844 |
| Case 2 | MD10 | | 10 | 10 | 0.101 | 42.1 | 0.012 | 0.001 | 0.0118582 |
| | MD15 | | 6 | 15 | 0.100 | 41.8 | 0.021 | 0.002 | 0.0139814 |
| | MD20 | | 6 | 20 | 0.102 | 41.6 | 0.031 | 0.002 | 0.0152644 |
| | MD25 | | 6 | 25 | 0.102 | 41.7 | 0.04 | 0.002 | 0.0156181 |
| | CD10 | | 10 | 10 | 0.101 | 41.5 | 0.005 | 0 | 0.0049593 |
| | CD15 | | 6 | 15 | 0.101 | 41.5 | 0.008 | 0.001 | 0.0052875 |
| | CD20 | | 6 | 20 | 0.099 | 39.7 | 0.012 | 0.001 | 0.0060468 |
| | CD25 | | 6 | 25 | 0.101 | 41.2 | 0.017 | 0.001 | 0.0067473 |
| Case 3 | MD10 | | 10 | 10 | 0.106 | 43.8 | 0.011 | 0.001 | 0.0103746 |
| | MD15 | | 6 | 15 | 0.104 | 43.0 | 0.018 | 0.001 | 0.0115121 |
| | MD20 | | 6 | 20 | 0.098 | 39.6 | 0.024 | 0.001 | 0.012289 |
| | MD25 | | 6 | 25 | 0.103 | 42.5 | 0.035 | 0.003 | 0.0136054 |
| | CD10 | | 10 | 10 | 0.103 | 41.5 | 0.004 | 0.001 | 0.0038974 |
| | CD15 | | 6 | 15 | 0.105 | 43.1 | 0.007 | 0 | 0.0044546 |
| | CD20 | | 6 | 20 | 0.098 | 39.5 | 0.011 | 0.001 | 0.005639 |
| | CD25 | | 6 | 25 | 0.105 | 43.4 | 0.016 | 0.001 | 0.0060788 |
| Case 4 | MD10 | | 10 | 10 | 0.097 | 39.9 | 0.012 | 0.001 | 0.0123496 |
| | MD15 | | 6 | 15 | 0.100 | 40.9 | 0.021 | 0.002 | 0.0139991 |
| | MD20 | | 6 | 20 | 0.097 | 40.4 | 0.031 | 0.001 | 0.0159915 |
| | MD25 | | 6 | 25 | 0.103 | 42.3 | 0.04 | 0.003 | 0.0155728 |
| | CD10 | | 10 | 10 | 0.101 | 41.8 | 0.005 | 0.001 | 0.0049639 |
| | CD15 | | 6 | 15 | 0.100 | 40.7 | 0.01 | 0.001 | 0.0066402 |
| | CD20 | | 6 | 20 | 0.098 | 40.5 | 0.012 | 0.001 | 0.0061277 |
| | CD25 | | 6 | 25 | 0.100 | 40.6 | 0.018 | 0.002 | 0.0071712 |
| Case 5 | MD10 | | 10 | 10 | 0.104 | 43.8 | 0.012 | 0.001 | 0.011568 |
| | MD15 | | 6 | 15 | 0.105 | 42.9 | 0.02 | 0.002 | 0.0127565 |
| | MD20 | | 6 | 20 | 0.102 | 42.3 | 0.028 | 0.002 | 0.0137432 |
| | MD25 | | 6 | 25 | 0.100 | 41.4 | 0.034 | 0.003 | 0.0135341 |
| | CD10 | | 10 | 10 | 0.100 | 41.8 | 0.005 | 0 | 0.0050064 |
| | CD15 | | 6 | 15 | 0.105 | 43.1 | 0.008 | 0.001 | 0.0050944 |
| | CD20 | | 6 | 20 | 0.101 | 42.9 | 0.012 | 0.001 | 0.0059378 |
| | CD25 | | 6 | 25 | 0.103 | 41.3 | 0.015 | 0.002 | 0.0058511 |
| Case 6 | MD10 | | 10 | 10 | 0.107 | 41.6 | 0.012 | 0.001 | 0.0112415 |
| | MD15 | | 6 | 15 | 0.108 | 42.9 | 0.02 | 0.002 | 0.0123577 |
| | MD20 | | 6 | 20 | 0.107 | 41.3 | 0.029 | 0.003 | 0.0135959 |
| | MD25 | | 6 | 25 | 0.106 | 40.6 | 0.037 | 0.002 | 0.0139638 |
| | CD10 | | 10 | 10 | 0.109 | 43.7 | 0.006 | 0.001 | 0.005499 |
| | CD15 | | 6 | 15 | 0.112 | 42.9 | 0.009 | 0 | 0.0053201 |
| | CD20 | | 6 | 20 | 0.104 | 40.4 | 0.012 | 0.001 | 0.0057616 |
| | CD25 | | 6 | 25 | 0.108 | 42.3 | 0.017 | 0.002 | 0.0082688 |
| Case 7 | MD10 | | 10 | 10 | 0.111 | 43.8 | 0.011 | 0.001 | 0.0099214 |
| | MD15 | | 6 | 15 | 0.109 | 42.7 | 0.017 | 0.002 | 0.0103914 |
| | MD20 | | 6 | 20 | 0.107 | 42.0 | 0.024 | 0.001 | 0.0111789 |
| | MD25 | | 6 | 25 | 0.112 | 43.9 | 0.036 | 0.003 | 0.0128072 |
| | CD10 | | 10 | 10 | 0.105 | 42.6 | 0.004 | 0.001 | 0.0037968 |
| | CD15 | | 6 | 15 | 0.109 | 42.3 | 0.007 | 0.001 | 0.0042976 |
| | CD20 | | 6 | 20 | 0.105 | 41.5 | 0.011 | 0.001 | 0.0052268 |
| | CD25 | | 6 | 25 | 0.109 | 42.5 | 0.016 | 0.001 | 0.0058901 |
| Case 8 | MD10 | | 10 | 10 | 0.109 | 43.2 | 0.014 | 0.002 | 0.0127985 |
| | MD15 | | 6 | 15 | 0.105 | 42.2 | 0.021 | 0.002 | 0.0132708 |
| | MD20 | | 6 | 20 | 0.106 | 42.4 | 0.031 | 0.003 | 0.0145818 |
| | MD25 | | 6 | 25 | 0.107 | 42.9 | 0.045 | 0.004 | 0.0168484 |
| | CD10 | | 10 | 10 | 0.104 | 40.6 | 0.005 | 0.001 | 0.0047978 |
| | CD15 | | 6 | 15 | 0.105 | 41.8 | 0.009 | 0.002 | 0.0056997 |
| | CD20 | | 6 | 20 | 0.101 | 40.2 | 0.013 | 0.001 | 0.0064172 |
| | CD25 | | 6 | 25 | 0.105 | 42.5 | 0.02 | 0.002 | 0.0076158 |
| Case 9 | MD10 | | 10 | 10 | 0.107 | 43.2 | 0.011 | 0.002 | 0.0102608 |
| | MD15 | | 6 | 15 | 0.106 | 43.5 | 0.019 | 0.002 | 0.0119606 |
| | MD20 | | 6 | 20 | 0.104 | 42.8 | 0.027 | 0.004 | 0.01293 |
| | MD25 | | 6 | 25 | 0.105 | 42.1 | 0.033 | 0.002 | 0.0125728 |
| | CD10 | | 10 | 10 | 0.114 | 42.2 | 0.005 | 0.001 | 0.0043933 |
| | CD15 | | 6 | 15 | 0.106 | 42.9 | 0.009 | 0.001 | 0.0056753 |
| | CD20 | | 6 | 20 | 0.105 | 43.0 | 0.012 | 0.002 | 0.0057334 |
| | CD25 | | 6 | 25 | 0.104 | 41.3 | 0.015 | 0.001 | 0.0057606 |

TABLE II.1-continued

Fracture energy and related data for tested handsheets

| Sample label | Sample Sub-label | Comments | Number of samples | L (mm) | t (mm) | B.W. (gsm) | Wf (J) | Wf - S.D. (J) | Wf/(Lt) (J/mm2) |
|---|---|---|---|---|---|---|---|---|---|
| Case 10A | MD10 | Repeat of Case 1 | 10 | 10 | 0.110 | 43.3 | 0.011 | 0.001 | 0.0100379 |
| | MD15 | | 6 | 15 | 0.105 | 42.8 | 0.019 | 0.002 | 0.0120377 |
| | MD20 | | 6 | 20 | 0.102 | 41.4 | 0.025 | 0.002 | 0.0122828 |
| | MD25 | | 6 | 25 | 0.104 | 41.6 | 0.035 | 0.003 | 0.0135057 |
| | CD10 | | 10 | 10 | 0.108 | 43.3 | 0.005 | 0.001 | 0.0046094 |
| | CD15 | | 6 | 15 | 0.105 | 42.7 | 0.008 | 0.001 | 0.0050664 |
| | CD20 | | 6 | 20 | 0.101 | 41.5 | 0.012 | 0.001 | 0.0059177 |
| | CD25 | | 6 | 25 | 0.103 | 41.2 | 0.016 | 0.001 | 0.0062018 |
| Case 10B | MD10 | Repeat of Case 1 | 10 | 10 | 0.105 | 42.1 | 0.011 | 0.001 | 0.0105243 |
| | MD15 | | 6 | 15 | 0.105 | 42.1 | 0.019 | 0.001 | 0.0121187 |
| | MD20 | | 6 | 20 | 0.104 | 42.5 | 0.026 | 0.003 | 0.0124613 |
| | MD25 | | 6 | 25 | 0.100 | 40.1 | 0.033 | 0.002 | 0.0132009 |
| | CD10 | | 10 | 10 | 0.101 | 39.3 | 0.004 | 0 | 0.0039791 |
| | CD15 | | 6 | 15 | 0.104 | 41.4 | 0.007 | 0.001 | 0.0044921 |
| | CD20 | | 6 | 20 | 0.103 | 40.8 | 0.012 | 0.001 | 0.0058174 |
| | CD25 | | 6 | 25 | 0.106 | 41.8 | 0.016 | 0.002 | 0.0060448 |
| Case 11 | MD10 | Case 1 calendered to 556 pli | 10 | 10 | 0.063 | 41.5 | 0.009 | 0.002 | 0.0142473 |
| | MD15 | | 6 | 15 | 0.065 | 42.3 | 0.019 | 0.004 | 0.0194418 |
| | MD20 | | 6 | 20 | 0.065 | 41.9 | 0.024 | 0.003 | 0.0183234 |
| | MD25 | | 6 | 25 | 0.063 | 41.5 | 0.038 | 0.001 | 0.024256 |
| | CD10 | | 10 | 10 | 0.062 | 41.1 | 0.004 | 0.001 | 0.0064931 |
| | CD15 | | 6 | 15 | 0.063 | 41.7 | 0.009 | 0.001 | 0.0094759 |
| | CD20 | | 6 | 20 | 0.063 | 40.5 | 0.013 | 0.002 | 0.0102591 |
| | CD25 | | 6 | 25 | 0.064 | 42.4 | 0.018 | 0.002 | 0.0112588 |
| Case 12 | MD10 | Case 1 calendered to 1111 pli | 10 | 10 | 0.054 | 42.1 | 0.006 | 0.001 | 0.0111198 |
| | MD15 | | 6 | 15 | 0.053 | 41.9 | 0.01 | 0.002 | 0.0126219 |
| | MD20 | | 6 | 20 | 0.054 | 41.3 | 0.014 | 0.002 | 0.0129518 |
| | MD25 | | 6 | 25 | 0.052 | 39.1 | 0.015 | 0.002 | 0.0115322 |
| | CD10 | | 10 | 10 | 0.054 | 41.6 | 0.003 | 0.001 | 0.0055809 |
| | CD15 | | 6 | 15 | 0.051 | 41.8 | 0.005 | 0 | 0.006495 |
| | CD20 | | 6 | 20 | 0.052 | 42.2 | 0.007 | 0.001 | 0.0066836 |
| | CD25 | | 6 | 25 | 0.051 | 40.0 | 0.009 | 0.001 | 0.0071181 |

TABLE II.2

Normalized fracture energies for handsheet study

| Sample label | Sample Sub-label | Comments | Wf/(Lt) (kJ/m2) | Wf/(L*B.W. (J.m/kg) | Wf/(L*B.W. (S.D.) |
|---|---|---|---|---|---|
| Case 1A | MD10 | Control | 10.49 | 26.57 | 2.42 |
| | MD15 | | 11.71 | 29.01 | 1.61 |
| | MD20 | | 12.36 | 31.11 | 1.20 |
| | MD25 | | 13.94 | 34.66 | 2.81 |
| | CD10 | | 3.87 | 9.49 | 0.00 |
| | CD15 | | 4.90 | 12.21 | 1.53 |
| | CD20 | | 5.32 | 13.22 | 1.20 |
| | CD25 | | 7.22 | 17.62 | 1.85 |
| 1B | MD10 | Repeat | 10.00 | 25.39 | 2.54 |
| | MD15 | | 13.31 | 33.42 | 5.01 |
| | MD20 | | 12.88 | 30.89 | 2.21 |
| | MD25 | | 15.32 | 37.22 | 3.92 |
| | CD10 | | 4.88 | 12.15 | 2.43 |
| | CD15 | | 5.95 | 15.11 | 1.68 |
| | CD20 | | 6.48 | 15.41 | 2.20 |
| | CD25 | | 6.73 | 16.61 | 0.92 |
| 1C | MD10 | Repeat | 11.53 | 28.15 | 2.35 |
| | MD15 | | 12.38 | 30.47 | 3.21 |
| | MD20 | | 13.19 | 31.90 | 2.36 |
| | MD25 | | 14.06 | 34.69 | 3.06 |
| | CD10 | | 5.83 | 13.79 | 2.30 |
| | CD15 | | 5.18 | 12.55 | 1.57 |
| | CD20 | | 5.94 | 14.32 | 0.00 |
| | CD25 | | 6.38 | 15.55 | 1.94 |
| Case 2 | MD10 | | 11.86 | 28.51 | 2.38 |
| | MD15 | | 13.98 | 33.49 | 3.19 |
| | MD20 | | 15.26 | 37.26 | 2.40 |
| | MD25 | | 15.62 | 38.37 | 1.92 |
| | CD10 | | 4.96 | 12.04 | 0.00 |
| | CD15 | | 5.29 | 12.85 | 1.61 |

TABLE II.2-continued

Normalized fracture energies for handsheet study

| Sample label | Sample Sub-label | Comments | Wf/(Lt) (kJ/m2) | Wf/(L*B.W. (J.m/kg) | Wf/(L*B.W. (S.D.) |
|---|---|---|---|---|---|
| | CD20 | | 6.05 | 15.11 | 1.26 |
| | CD25 | | 6.75 | 16.52 | 0.97 |
| Case 3 | MD10 | | 10.37 | 25.10 | 2.28 |
| | MD15 | | 11.51 | 27.89 | 1.55 |
| | MD20 | | 12.29 | 30.30 | 1.26 |
| | MD25 | | 13.61 | 32.94 | 2.82 |
| | CD10 | | 3.90 | 9.65 | 2.41 |
| | CD15 | | 4.45 | 10.82 | 0.00 |
| | CD20 | | 5.64 | 13.92 | 1.27 |
| | CD25 | | 6.08 | 14.76 | 0.92 |
| Case 4 | MD10 | | 12.35 | 30.08 | 2.51 |
| | MD15 | | 14.00 | 34.20 | 3.26 |
| | MD20 | | 15.99 | 38.35 | 1.24 |
| | MD25 | | 15.57 | 37.83 | 2.84 |
| | CD10 | | 4.96 | 11.95 | 2.39 |
| | CD15 | | 6.64 | 16.37 | 1.64 |
| | CD20 | | 6.13 | 14.81 | 1.23 |
| | CD25 | | 7.17 | 17.72 | 1.97 |
| Case 5 | MD10 | | 11.57 | 27.38 | 2.28 |
| | MD15 | | 12.76 | 31.06 | 3.11 |
| | MD20 | | 13.74 | 33.10 | 2.36 |
| | MD25 | | 13.53 | 32.86 | 2.90 |
| | CD10 | | 5.01 | 11.95 | 0.00 |
| | CD15 | | 5.09 | 12.37 | 1.55 |
| | CD20 | | 5.94 | 13.98 | 1.17 |
| | CD25 | | 5.85 | 14.54 | 1.94 |
| Case 6 | MD10 | | 11.24 | 28.85 | 2.40 |
| | MD15 | | 12.36 | 31.06 | 3.11 |
| | MD20 | | 13.60 | 35.14 | 3.63 |
| | MD25 | | 13.96 | 35.45 | 1.87 |

TABLE II.2-continued

Normalized fracture energies for handsheet study

| Sample label | Sample Sub-label | Comments | Wf/(Lt) (kJ/m2) | Wf/(L*B.W. (J.m/kg) | Wf/(L*B.W. (S.D.) |
|---|---|---|---|---|---|
| | CD10 | | 5.50 | 13.72 | 2.29 |
| | CD15 | | 5.37 | 13.99 | 0.00 |
| | CD20 | | 5.76 | 14.85 | 1.24 |
| | CD25 | | 6.27 | 16.08 | 1.89 |
| Case 7 | MD10 | | 9.92 | 25.11 | 2.28 |
| | MD15 | | 10.39 | 26.52 | 3.12 |
| | MD20 | | 11.18 | 28.57 | 1.19 |
| | MD25 | | 12.81 | 32.83 | 2.74 |
| | CD10 | | 3.80 | 9.40 | 2.35 |
| | CD15 | | 4.30 | 11.03 | 1.58 |
| | CD20 | | 5.23 | 13.26 | 1.21 |
| | CD25 | | 5.89 | 15.06 | 0.94 |
| Case 8 | MD10 | | 12.80 | 32.42 | 4.63 |
| | MD15 | | 13.27 | 33.16 | 3.16 |
| | MD20 | | 14.58 | 36.54 | 3.54 |
| | MD25 | | 16.85 | 41.96 | 3.73 |
| | CD10 | | 4.80 | 12.33 | 2.47 |
| | CD15 | | 5.70 | 14.35 | 3.19 |
| | CD20 | | 6.42 | 16.17 | 1.24 |
| | CD25 | | 7.62 | 18.82 | 1.88 |
| Case 9 | MD10 | | 10.26 | 25.47 | 4.63 |
| | MD15 | | 11.96 | 29.15 | 3.07 |
| | MD20 | | 12.93 | 31.53 | 4.67 |
| | MD25 | | 12.57 | 31.35 | 1.90 |
| | CD10 | | 4.39 | 11.85 | 2.37 |
| | CD15 | | 5.68 | 13.98 | 1.55 |
| | CD20 | | 5.73 | 13.95 | 2.33 |
| | CD25 | | 5.76 | 14.53 | 0.97 |
| Case 10A | MD10 | Repeat of Case 1 | 10.04 | 25.39 | 2.31 |
| | MD15 | | 12.04 | 29.57 | 3.11 |
| | MD20 | | 12.28 | 30.21 | 2.42 |
| | MD25 | | 13.51 | 33.65 | 2.88 |

TABLE II.2-continued

Normalized fracture energies for handsheet study

| Sample label | Sample Sub-label | Comments | Wf/(Lt) (kJ/m2) | Wf/(L*B.W. (J.m/kg) | Wf/(L*B.W. (S.D.) |
|---|---|---|---|---|---|
| | CD10 | | 4.61 | 11.54 | 2.31 |
| | CD15 | | 5.07 | 12.49 | 1.56 |
| | CD20 | | 5.92 | 14.46 | 1.20 |
| | CD25 | | 6.20 | 15.55 | 0.97 |
| Case 10B | MD10 | Repeat of Case 1 | 10.52 | 26.14 | 2.38 |
| | MD15 | | 12.12 | 30.09 | 1.58 |
| | MD20 | | 12.46 | 30.58 | 3.53 |
| | MD25 | | 13.20 | 32.92 | 2.00 |
| | CD10 | | 3.98 | 10.18 | 0.00 |
| | CD15 | | 4.49 | 11.27 | 1.61 |
| | CD20 | | 5.82 | 14.69 | 1.22 |
| | CD25 | | 6.04 | 15.32 | 1.92 |
| Case 11 | MD10 | Case 1 calendered to 556 pli | 14.25 | 21.71 | 4.83 |
| | MD15 | | 19.44 | 29.94 | 6.30 |
| | MD20 | | 18.32 | 28.64 | 3.58 |
| | MD25 | | 24.26 | 36.66 | 0.96 |
| | CD10 | | 6.49 | 9.74 | 2.43 |
| | CD15 | | 9.48 | 14.39 | 1.60 |
| | CD20 | | 10.26 | 16.04 | 2.47 |
| | CD25 | | 11.26 | 16.98 | 1.89 |
| Case 12 | MD10 | Case 1 calendered to 1111 pli | 11.12 | 14.26 | 2.38 |
| | MD15 | | 12.62 | 15.91 | 3.18 |
| | MD20 | | 12.95 | 16.96 | 2.42 |
| | MD25 | | 11.53 | 15.36 | 2.05 |
| | CD10 | | 5.58 | 7.21 | 2.40 |
| | CD15 | | 6.49 | 7.97 | 0.00 |
| | CD20 | | 6.68 | 8.30 | 1.19 |
| | CD25 | | 7.12 | 9.00 | 1.00 |

Appendix III

TABLE III.1

Physical Properties of Test Samples

| Sample | Basis wt. ($g/m^2$) | Thickness (mm) | Apparent density ($g/cm^3$) | Extension at break (%) | Tensile strength (MPa) | Elastic modulus (MPa) | 0.2% Yield stress (MPa) |
|---|---|---|---|---|---|---|---|
| Case 1 MD | 42.9 | 0.104 | 0.415 | 2.761 | 30.7 | 2,667 | 19.7 |
| Case 1 CD | 42.9 | 0.104 | 0.415 | 2.285 | 9.3 | 895 | 7.3 |
| Case 2 MD | 43 | 0.105 | 0.410 | 2.377 | 30.7 | 2,850 | 20.2 |
| Case 2 CD | 43 | 0.105 | 0.410 | 2.051 | 10.2 | 989 | 8.3 |
| Case 3 MD | 42.1 | 0.100 | 0.422 | 2.474 | 30.4 | 2,726 | 19.6 |
| Case 3 CD | 42.1 | 0.100 | 0.422 | 2.243 | 9.3 | 917 | 7.4 |
| Case 4 MD | 40.3 | 0.100 | 0.402 | 2.023 | 30.3 | 2,877 | 20.7 |
| Case 4 CD | 40.3 | 0.100 | 0.402 | 2.408 | 11.4 | 1,177 | 8.8 |
| Case 5 MD | 43.4 | 0.102 | 0.425 | 2.283 | 31.4 | 2,719 | 21.6 |
| Case 5 CD | 43.4 | 0.102 | 0.425 | 2.831 | 10.4 | 1,018 | 7.7 |
| Case 6 MD | 42.5 | 0.109 | 0.391 | 2.350 | 30.0 | 2,646 | 20.0 |
| Case 6 CD | 42.5 | 0.109 | 0.391 | 2.038 | 9.2 | 916 | 7.2 |
| Case 7 MD | 41.6 | 0.106 | 0.391 | 2.405 | 24.6 | 2,274 | 17.1 |
| Case 7 CD | 41.6 | 0.106 | 0.391 | 1.902 | 8.8 | 909 | 7.1 |
| Case 8 MD | 42.5 | 0.103 | 0.411 | 2.569 | 30.8 | 2,742 | 19.1 |
| Case 8 CD | 42.5 | 0.103 | 0.411 | 2.134 | 9.9 | 1,015 | 7.9 |
| Case 9 MD | 41.1 | 0.102 | 0.403 | 2.460 | 26.5 | 2,483 | 17.3 |
| Case 9 CD | 41.1 | 0.102 | 0.403 | 1.996 | 8.6 | 919 | 6.6 |
| Case 10 MD | 41.5 | 0.063 | 0.658 | 2.242 | 38.9 | 3,705 | 26.7 |
| Case 10 CD | 41.5 | 0.063 | 0.658 | 2.680 | 13.7 | 1,083 | 9.2 |
| Case 11 MD | 41.3 | 0.057 | 0.727 | 0.718 | 24.3 | 4,421 | |
| Case 11 CD | 41.3 | 0.057 | 0.727 | 1.478 | 10.4 | 1,234 | 8.8 |

TABLE III.2

Fracture Toughness Data

| Sample | Fracture toughness (J.m/kg) | Fracture toughness (R-squared) | Fracture toughness (MD/CD) | Ductility (= β * $w_p$) (J/g) |
|---|---|---|---|---|
| Case 1 MD | 21.10 | 0.987 | 4.96 | 0.528 |
| Case 1 CD | 4.25 | 0.942 | | 0.508 |
| Case 2 MD | 22.70 | 0.935 | 2.63 | 0.667 |
| Case 2 CD | 8.63 | 0.972 | | 0.314 |
| Case 3 MD | 20.00 | 0.999 | 3.43 | 0.519 |
| Case 3 CD | 5.83 | 0.949 | | 0.369 |
| Case 4 MD | 25.50 | 0.852 | 2.63 | 0.548 |
| Case 4 CD | 9.70 | 0.673 | | 0.315 |
| Case 5 MD | 24.60 | 0.817 | 2.48 | 0.37 |
| Case 5 CD | 9.93 | 0.945 | | 0.188 |
| Case 6 MD | 23.50 | 0.966 | 1.97 | 0.538 |
| Case 6 CD | 11.90 | 0.93 | | 0.158 |
| Case 7 MD | 19.40 | 0.937 | 3.55 | 0.504 |
| Case 7 CD | 5.46 | 0.997 | | 0.384 |
| Case 8 MD | 24.80 | 0.903 | 3.12 | 0.64 |
| Case 8 CD | 7.96 | 0.993 | | 0.426 |
| Case 9 MD | 22.40 | 0.841 | 2.07 | 0.401 |
| Case 9 CD | 10.80 | 0.765 | | 0.16 |
| Case 10 MD | 14.00 | 0.842 | 2.29 | 0.87 |
| Case 10 CD | 6.11 | 0.88 | | 0.467 |
| Case 11 MD | 14.10 | 0.248 | 2.30 | 0.087 |
| Case 11 CD | 6.13 | 0.979 | | 0.114 |

TABLE III.3

Miscellaneous Strength-Related Properties

| Sample | Internal bond ($10^{-3}$) (ft.-lbf) | Tear (gf) | Tear (MD/CD) | Stiffness (Gurley) (mgf) | Z-direction tensile (lb/in$^2$) | Zero-span tensile (N/cm) | Formation index (Kajaani) |
|---|---|---|---|---|---|---|---|
| Case 1 MD | 118 | 25.6 | 0.542 | 50.9 | 98 | 70.8 | 99 |
| Case 1 CD | 132 | 47.2 | | 17.2 | 98 | 28 | 99 |
| Case 2 MD | 126 | 22.4 | 0.500 | 53.9 | 124 | 70.4 | 99.3 |
| Case 2 CD | 130 | 44.8 | | 19 | 124 | 30.8 | 99.3 |
| Case 3 MD | 104 | 20.8 | 0.456 | 46.3 | 113 | 68.9 | 101 |
| Case 3 CD | 96 | 45.6 | | 14.6 | 113 | 27.6 | 101 |
| Case 4 MD | 127 | 22.4 | 0.483 | 45.8 | 106 | 67 | 96 |
| Case 4 CD | 129 | 46.4 | | 16.2 | 106 | 30.4 | 96 |
| Case 5 MD | 115 | 24 | 0.484 | 48.5 | 114 | 70.8 | 97.7 |
| Case 5 CD | 116 | 49.6 | | 18.2 | 114 | 28.4 | 97.7 |
| Case 6 MD | 137 | 25.6 | 0.533 | 52.9 | 110 | 70 | 100.3 |
| Case 6 CD | 128 | 48 | | 20.2 | 110 | 28.4 | 100.3 |
| Case 7 MD | 98 | 22.4 | 0.500 | 43.7 | 103 | 61.2 | 101.3 |
| Case 7 CD | 95 | 44.8 | | 17.3 | 103 | 27.2 | 101.3 |
| Case 8 MD | 129 | 26.4 | 0.465 | 50.8 | 107 | 71.2 | 97.7 |
| Case 8 CD | 125 | 56.8 | | 16.2 | 107 | 30.4 | 97.7 |
| Case 9 MD | 102 | 24 | 0.508 | 42.9 | 104 | 63.5 | 101 |
| Case 9 CD | 103 | 47.2 | | 16.1 | 104 | 28.4 | 101 |
| Case 10 MD | 97 | 13.5 | 0.375 | 22.9 | 88 | 64.3 | 107.5 |
| Case 10 CD | 88 | 36 | | 6.8 | 88 | 28 | 107.5 |
| Case 11 MD | 104 | 15 | 0.725 | 20.4 | 101 | 63 | 88.5 |
| Case 11 CD | 110 | 20.7 | | 5.57 | 101 | 26.8 | 88.5 |

What is claimed is:

1. A method for manufacturing paper/paperboard, comprising the following steps:

(a) manufacturing paper/paperboard product of a particular grade having a first set of respective values for a plurality of material properties that affect fracture toughness;

(b) measuring the fracture toughness of said paper/paperboard product;

(c) determining that the measured fracture toughness of said paper/paperboard product is different than a desired fracture toughness;

(d) determining a second set of respective values for said plurality of material properties that will produce a fracture toughness closer to said desired fracture toughness than was said measured fracture toughness; and (e) manufacturing paper/paperboard product of said particular grade having respective values for said plurality of material properties that are respectively substantially equal to said first set of respective values, wherein said measuring step comprises determining the essential work of fracture, said step of determining a second set of respective values for said group of material properties is performed using a mathematical model of fracture toughness as a function of said plurality of material properties, and said plurality of material properties comprise filler level, softwood pulp content and caliper.

2. The method as recited in claim 1, wherein said mathematical model of fracture toughness is of the form:

$$FT=\beta_0-\beta_1x_1+\beta_2x_2+\beta_3z_2$$

where $x_1$ is a function of filler level, $x_2$ is a function of softwood pulp content, $z_2$ is a function of caliper, and $\beta_0$ through $\beta_3$ are constants.

3. A method for operating a paper mill, comprising the following steps:

manufacturing different grades of paper or paperboard;

measuring the fracture toughness of test samples of paper or paperboard taken from multiple production runs;

for each of a multiplicity of production runs, storing fracture toughness measurements and associated material property data in a databank;

retrieving from said databank a set of material property data for a grade of paper or paperboard; and manufacturing a grade of paper or paperboard product having material properties that are respectively substantially equal to values in said material property data retrieved from said databank, wherein each set of material property data comprises respective data for caliper, softwood pulp content and filler level of a respective grade of paper or paperboard.

4. A method for designing a grade of paper or paperboard, comprising the following step:

performing a factorial experiment to investigate the effects of papermaking variables on in-plane fracture toughness of a grade of paper or paperboard;

analyzing data acquired by said factorial experiment to derive a statistically significant mathematical model for fracture toughness as a function of a plurality of material properties of said grade of paper or paperboard; and selecting a desired fracture toughness for a grade of paper or paperboard to be manufactured and determining values for said plurality of material properties which, when input to said mathematical model, produce a calculated fracture toughness approximately equal to said desired fracture toughness, wherein said plurality of material properties comprise caliper, softwood pulp content and filler level.

5. The method as recited in claim 4, further comprising the steps of:

manufacturing a plurality of paper or paperboard products of a particular grade, each product having a different fracture toughness;

converting said products in a printing press;

acquiring data reflecting the press runnability performance of each of said products in said printing press; and determining an optimal range of fracture toughness based on acquired press runnability performance data, wherein said desired fracture toughness is selected from said optimal range of fracture toughness.

6. The method as recited in claim 4, further comprising the step of manufacturing a paper or paperboard product having the material properties that were input to said mathematical model.

7. The method as recited in claim 4, wherein said mathematical model of fracture toughness is of the form:

$$FT=\beta_0-\beta_1x_1+\beta_2x_2+\beta_3z_2$$

where $x_1$ is a function of filler level, $x_2$ is a function or softwood pulp content, $z_2$ is a function of caliper, and $\beta_0$ through $\beta_1$ are constants.

8. A method for making paper/paperboard, comprising the following steps:

(a) conducting a factorial experiment to investigate the effects of papermaking variables on in-plane fracture toughness of paper/paperboard;

(b) determining a functional relationship between a plurality of material properties of paper/paperboard from data acquired during said factorial experiment, one of said material properties being fracture toughness;

(c) manufacturing a first paper/paperboard product for which said material properties other than fracture toughness have a first set of respective selected values;

(d) measuring the fracture toughness of said first paper/paperboard product;

(e) determining a deviation of said measured fracture toughness from a desired fracture toughness;

(f) determining a second set of respective selected values of said material properties other than fracture toughness that are calculated to produce a product having a fracture toughness closer than said measured fracture toughness to said desired fracture toughness, said second set of respective selected values being derived by applying said functional relationship to said first set of respective selected values and said deviation; and (g) manufacturing a second paper/paperboard product for which said material properties other than fracture toughness have said second set of respective selected values, wherein material properties comprise filler level, softwood pulp content and caliper.

9. The method as recited in claim 8, wherein said functional relationship is of the form:

$$FT=\beta_0-\beta_1x_1+\beta_2x_2+\beta_3z_2$$

where $x_1$ is a function of filler level, $x_2$ is a function of softwood pulp content, $z_2$ is a function of caliper, and $\beta_0$ through $\beta_3$ are constants.

10. A method for making paper/paperboard, comprising the following steps:

(a) formulating a first mathematical model of fracture toughness of paper/paperboard as a function of a plurality of variables, each variable representing a respective material property of the paper/paperboard;

(b) determining a desired fracture roughness value;

(c) determining respective values for each of said plurality of variables which, when inserted in said first mathematical model, result in a fracture toughness value approximately equal to said desired fracture toughness value; and (d) manufacturing a paper/paperboard product having respective material properties represented by respective values that are substantially equal to said determined respective values, wherein said variables used in said first mathematical model represent filler level, softwood pulp content and caliper.

11. The method as recited in claim 10, wherein said first mathematical model of fracture toughness is of the form:

$$FT=\beta_0-\beta_1x_1+\beta_2x_2+\beta_3z_2$$

where $x_1$ is a function of filler level, $x_2$ is a function of softwood pulp content, $z_2$ is a function of caliper, and $\beta_0$ through $\beta_3$ are constants.

12. The method as recited in claim 10, further comprising the steps of:

(e) formulating a second mathematical model of stiffness of paper/paperboard as a function of a plurality of variables, each variable representing a respective material property of the paper/paperboard; and (f) determining a stiffness value by inserting values for said variables in said second mathematical model, wherein two of said values were determined in step (c).

13. The method as recited in claim 12, wherein said variables used in said second mathematical model represent filler level, basis weight and caliper.

14. The method as recited in claim 10, further comprising the steps of:

(e) formulating a second mathematical model of internal bond of paper/paperboard as a function of a plurality of variables, each variable representing a respective material property of the paper/paperboard; and (f) determining an internal bond value by inserting values for said variables in said second mathematical model, wherein one of said values was determined in step (c).

15. The method as recited in claim 14, wherein said variables used in said second mathematical model represent filler level, basis weight and relative humidity.

* * * * *